US009024160B2

(12) United States Patent
Suenaga

(10) Patent No.: US 9,024,160 B2
(45) Date of Patent: May 5, 2015

(54) SILENCER

(71) Applicant: Yamaha Corporation, Hamamatsu-Shi, Shizuoka-Ken (JP)

(72) Inventor: Yuichiro Suenaga, Hamamatsu (JP)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 14/176,556

(22) Filed: Feb. 10, 2014

(65) Prior Publication Data

US 2014/0224098 A1 Aug. 14, 2014

(30) Foreign Application Priority Data

Feb. 13, 2013 (JP) ..... 2013-025091

(51) Int. Cl.
*G10D 9/06* (2006.01)

(52) U.S. Cl.
CPC ..... *G10D 9/06* (2013.01)

(58) Field of Classification Search
CPC ..... G10D 7/005; G10D 9/02; G10D 9/06; G10D 7/00; G10G 5/005; G10G 5/00; G10G 7/00
See application file for complete search history.

(56) References Cited

U.S. PATENT DOCUMENTS

| | | | | |
|---|---|---|---|---|
| 738,472 | A | 9/1903 | Neumann | |
| 1,546,258 | A | 7/1925 | Schluesselburg | |
| 1,578,763 | A | 3/1926 | Schluesselburg | |
| 1,702,561 | A | 2/1929 | Santa Emma | |
| 1,767,974 | A | 6/1930 | Godbery | |
| 2,108,769 | A | 2/1938 | Humes | |
| 2,439,733 | A | 4/1948 | Hermes | |
| 3,760,679 | A | 9/1973 | Gossick et al. | |
| 4,273,022 | A | 6/1981 | Bell | |
| 2013/0047818 | A1 * | 2/2013 | Hamanaga | 84/400 |

FOREIGN PATENT DOCUMENTS

| | | | | |
|---|---|---|---|---|
| JP | 2008-096498 | A | 4/2008 | |
| JP | 4114171 | B2 | 7/2008 | |
| JP | 4986091 | B1 | 7/2012 | |
| JP | 2013054351 | A * | 3/2013 | 84/400 |

OTHER PUBLICATIONS

Extended European Search Report issued for EP 14 15 4454, mailing date Jun. 12, 2014.

* cited by examiner

*Primary Examiner* — Kimberly Lockett
(74) *Attorney, Agent, or Firm* — Dickstein Shapiro LLP

(57) ABSTRACT

A silencer includes: a main body including (a) a cylindrical portion whose outer circumferential surface is mounted on an inner circumferential surface of a bell of a wind instrument and (b) a closing portion configured to close one end portion of opposite end portions of the cylindrical portion; and a pipe including (i) a first end portion opening inside the main body and (b) a second end portion opening outside the main body. The first end portion of the pipe is disposed at a vicinity of the closing portion. The pipe is bent between the first end portion and the second end portion.

13 Claims, 9 Drawing Sheets

SILENCER

CROSS REFERENCE TO RELATED APPLICATION

The present application claims priority from Japanese Patent Application No. 2013-025091, which was filed on Feb. 13, 2013, the disclosure of which is herein incorporated by reference in its entirety.

BACKGROUND OF THE INVENTION

1. Field of the Invention

The present invention relates to a silencer.

2. Description of the Related Art

There is conventionally known, as a silencer used for a wind instrument, a silencer whose outer circumferential surface is mounted on an inner circumferential surface of a bell of a wind instrument. For example, Patent Document 1 (Japanese Patent No. 4114171) discloses a silencer having an inner space and including a body and a bottom portion shaped like a bowl, and this silencer has a breath discharge passage having a predetermined length and communicating with the inner space to discharge a breath to an outside space.

SUMMARY OF THE INVENTION

It has been found in the conventional technique that the breath discharge passage formed in the silencer greatly affects performance of the silencer. However, Patent Document 1 has description "the breath discharge passage may have any construction and is not limited in particular as long as the breath discharge passage has such a length that the breath discharge passage functions as resistance to sound waves". That is, in the conventional technique, the breath discharge passage cannot be constructed in the silencer so as to improve the performance of the silencer.

This invention has been developed in view of the above-described situations, and it is an object of the present invention to provide a high-performance silencer (including a mute).

The object indicated above may be achieved according to the present invention which provides a silencer comprising: a main body comprising a cylindrical portion whose outer circumferential surface is mounted on an inner circumferential surface of a bell of a wind instrument, and a closing portion configured to close one end portion of opposite end portions of the cylindrical portion; and a pipe comprising a first end portion opening inside the main body, and a second end portion opening outside the main body, wherein the first end portion of the pipe is disposed at a vicinity of the closing portion, and wherein the pipe is bent between the first end portion and the second end portion.

In the silencer constructed as described above, the first end portion is disposed near the closing portion to prevent generation of dips and peaks in sounds in an audible range. That is, when the first end portion of the pipe is disposed in the main body of the silencer, the pipe is mounted on the main body in the state in which the first end portion is located near the closing portion. In the construction in which the first end portion is disposed near the closing portion, frequencies at dips and peaks (i.e., specific frequencies related to a distance between the first end portion and the closing portion) fall outside the audible range.

FORMS OF THE INVENTION

The object indicated above may be achieved according to the present invention which provides a silencer comprising: a main body comprising a cylindrical portion whose outer circumferential surface is mounted on an inner circumferential surface of a bell of a wind instrument, and a closing portion configured to close one end portion of opposite end portions of the cylindrical portion; and a pipe comprising a first end portion opening inside the main body, and a second end portion opening outside the main body, wherein the first end portion of the pipe is disposed at a vicinity of the closing portion, and wherein the pipe is bent between the first end portion and the second end portion.

The cylindrical portion is mounted on the inner circumferential surface of the bell such that the outer circumferential surface of the cylindrical portion is held in contact with the inner circumferential surface of the bell of the wind instrument. As a result, a breath of a player does not leak from a position between the outer circumferential surface of the silencer and the inner circumferential surface of the bell, requiring a discharge of the breath of the player. In the construction described above, the main body of the silencer is made hollow by the cylindrical portion and the closing portion, and since the end portion of the cylindrical portion which is further from the closing portion is open, the breath of the player is delivered from the wind instrument into the main body of the silencer. Also, the first end portion of the pipe is open in the main body, and the second end portion is open outside the main body. Thus, the breath of the player is delivered from the first end portion into the pipe and discharged from the second end portion to an outside of the main body.

In the silencer constructed as described above, the closing portion serves as a reflective surface for sounds produced by the wind instrument. In the silencer, consequently, there are sound waves of direct sounds traveling toward the closing portion and sound waves of reflected sounds reflected from the closing portion and traveling toward the player. The sound waves of the direct sounds and the sound waves of the reflected sounds exist also near the first end portion of the pipe which opens in the silencer. Accordingly, in a case where twice a distance between the first end portion and the closing portion (i.e., a difference between the length of a path for the direct sound and the length of a path for the reflected sound) is equal to an odd-numbered multiple of a half-wavelength of the sound wave or an integral multiple of a wavelength, the sound waves of the direct sounds and the sound waves of the reflected sounds interfere with each other, so that the sound waves are made excessively small or large. As a result, sound waves having dips and peaks at specific frequencies related to the distance between the first end portion and the closing portion are output from the pipe.

To solve this problem, the first end portion is disposed near the closing portion in the above-described construction to prevent generation of dips and peaks in sounds in an audible range. That is, when the first end portion of the pipe is disposed in the main body of the silencer, the pipe is mounted on the main body in the state in which the first end portion is located near the closing portion. In the construction in which the first end portion is disposed near the closing portion, the frequencies at dips and peaks (i.e., the specific frequencies related to the distance between the first end portion and the closing portion) fall outside the audible range.

Specifically, by setting the distance between the first end portion and the closing portion at several millimeters, no interference occurs in the audible range. That is, to make the difference in length of path (i.e., twice the distance between the first end portion and the closing portion) a half of a wavelength, the distance between the first end portion and the closing portion needs to be determined at a quarter of the wavelength. Assuming that an upper limit frequency of sounds in the audible range is 5 kHz and that a sound velocity is 340 m/s, the wavelength is 0.068 m (=340/5000). Since a quarter of this wavelength is 17 mm, in a case where the distance between the first end portion of the pipe and the closing portion in a direction of an axis of the cylindrical portion is less than 17 mm, sounds having mannerisms at dips and peaks in the sound waves within the audible range are not output from the pipe. Also, assuming that the upper limit frequency of sounds in the audible range is 20 kHz and that the sound velocity is 340 m/s, the wavelength is 0.017 m (=340/20000). Since a quarter of this wavelength is 4.25 mm, in a case where the distance between the first end portion of the pipe and the closing portion in the direction of the axis of the cylindrical portion is less than 4.25 mm, sounds having mannerisms at dips and peaks in the sound waves within the audible range are not output from the pipe. Accordingly, a high-performance silencer can be provided.

When a player plays a trumpet using the silencer, the player produces a sound by vibrating air existing between a mouthpiece and the silencer. In a case where there is an acoustic resistor in the silencer, vibrations of air are less freely generated, stabilizing sound waves to be produced in the silencer. The silencer according to the present invention includes the pipe whose first end portion is open inside the main body and whose second end portion is open outside the main body, and the breath of the player supplied into the pipe inside the silencer is discharged to the outside of the silencer through the pipe. Accordingly, in the construction in which the pipe is provided in the silencer, the sound waves can be stabilized easily when compared with a construction in which no pipe is provided in the silencer. The silencer may be further constructed such that the first end portion of the pipe is disposed so as to face the closing portion in a first direction coinciding with a direction of the axis of the cylindrical portion. Also, the silencer may be further constructed such that an opening is formed in another end portion of the opposite end portions of the cylindrical portion, and the opening formed in the first end portion of the pipe is open in a direction directed from said another end portion of the cylindrical portion to the one end portion.

In the construction for stabilizing sound waves by the pipe as the acoustic resistor provided in the silencer, the longer the length of the pipe, the more easily it is possible to lower the degree of freedom in generation of vibrations of the air. Thus, the longer the length of the pipe, the more easily the sound wave to be produced in the silencer can be stabilized. In the present invention, the pipe is bent between the first end portion and the second end portion. That is, since the pipe is bent between the first end portion and the second end portion, the pipe can be made longer even in a construction in which the pipe is disposed in a limited space defined inside the silencer. This construction results in smaller size in the silencer and more stabilized sound waves to be produced in the silencer, providing a silencer which generally offers high performance.

Also, in the silencer having the construction in which the outer circumferential surface of the cylindrical portion of the silencer is mounted while contacting the inner circumferential surface of the bell of the wind instrument, and an open end of the cylindrical portion (i.e., an end portion thereof near the bell) is closed by the closing portion, the closing portion functions as a reflective surface for a sound output from the wind instrument. In this construction, in general, a position of the silencer mounted on the wind instrument is adjusted in order to reduce variations between a pitch of a sound output from the wind instrument in the case where the silencer is used and a pitch of a sound output from the wind instrument in a case where no silencer is used.

The closing portion needs to serve as the reflective surface for sound waves. Thus, in a case where the closing portion has a hole for establishing direct communication between the inside and outside of the silencer (i.e., a hole for communication between front and back sides of the closing portion or outside and inside of the main body) or where the pipe does not have enough length, the closing portion less functions as the reflective surface for sound waves, making it more difficult to stabilize sound waves. In the present invention, however, the silencer is constructed such that the breath of the player which is supplied from the first end portion is discharged from the second end portion through the pipe, that is, the second end portion of the pipe is supported by a support portion formed in the cylindrical portion and is open to the outside of the main body through a through hole formed in the closing portion. Even in a case of a construction in which the second end portion of the pipe is mounted on the hole formed in the closing portion, the closing portion does not need to have the hole for establishing the direct communication between the inside and outside of the silencer. Accordingly, the sound waves can be easily stabilized when compared with the case where the closing portion has the hole for establishing the direct communication between the inside and outside of the silencer or the case where the pipe does not have enough length. Also, in the construction in which the closing portion functions as the reflective surface for sound waves, the closing portion clearly functions as the reflective surface with the longer length of the pipe (that is, a situation is established which differs from a situation in which a hole is directly formed in the closing portion), variations of sounds emitted from a wind instrument can be reduced when compared with the case of the silencer with a reduced function of the closing portion.

Here, the cylindrical portion constituting the main body of the silencer may have any construction as long as the outer circumferential surface of the cylindrical portion is mounted while contacting the inner circumferential surface of the bell of the wind instrument to prevent the breath of the player from leaking from the position between the outer circumferential surface of the silencer and the inner circumferential surface of the bell. Accordingly, a component for increasing a degree of contact between the outer circumferential surface of the cylindrical portion and the inner circumferential surface of the bell may be mounted on the outer circumferential surface of the cylindrical portion, and the cylindrical portion may be constructed such that the shape of its outer circumferential surface changes more gently than that of the bell along the shape of the bell of the wind instrument (for example, such that the diameter of the outer circumferential surface gradually increases outwardly more gently than the bell). The cylindrical portion may have any construction as long as opposite ends of the cylindrical portion along its axis are open by existence of a wall surface of a thin plate around the axis, and a material and diameters of outer and inner circumferences of the cylindrical portion are not limited.

The closing portion has any construction as long as the closing portion constitutes a wall surface for closing the one end portion of the cylindrical portion. For example, the closing portion may have a construction in which a thin plate member is mounted on the one end portion of the cylindrical portion. That is, the main body is mounted on the wind instrument by inserting, into the wind instrument, the other end portion of the cylindrical portion which is opposed to the end portion of the cylindrical portion on which the closing portion is mounted (i.e., the one end portion) and by bringing the outer circumferential surface of the cylindrical portion into contact with the inner circumferential surface of the bell of the wind instrument. As a result, the closing portion is exposed to the outside of the wind instrument, and the other end portion of the cylindrical portion is hidden inside the wind instrument. For example, in the case of the trumpet, the closing portion is disposed on an opposite side of the cylindrical portion from the player, and the other end portion of the cylindrical portion is disposed near the player. It should be understood that the closing portion and the cylindrical portion may be formed integrally with each other, and the closing portion and the cylindrical portion provided separately from each other may be connected to each other.

The pipe has any construction as long as its both ends are open and the pipe is bent between the first end portion and the second end portion such that the first end portion is open inside the main body and such that the second end portion is open to the outside of the main body. A change in curvature of the pipe between the first end portion and the second end portion is not limited in particular. For example, straight portions and bent portions may be bonded to each other, and the pipe may be bent such that its curvature continuously changes (e.g., a helical shape). It is noted that the curvature may change in a discrete manner, but the curvature preferably changes continuously to prevent occurrences of dips and peaks in specific sound waves and deterioration of a blowing sensation, for example.

The second end portion may be open in the cylindrical portion and may be open in the closing portion. In the construction in which the second end portion is open in the closing portion, the silencer may be constructed, for example, such that a thorough hole to which the pipe is to be mounted is formed in the closing portion, and the pipe is mounted on the thorough hole, whereby the second end portion is open to the outside of the main body. That is, since the first end portion is disposed near the closing portion, the first end portion of the pipe is open near the closing portion, and the pipe is mounted on the thorough hole of the closing portion to close the thorough hole, and the second end portion is open to the outside of the silencer.

To achieve this construction using the bent pipe, the pipe extends from the first end portion located near the closing portion toward the opposite side of the cylindrical portion from the closing portion (i.e., toward the player) and then be bent so as to extend toward the closing portion, and a thorough hole is formed at a position at which the pipe reaches the closing portion, the pipe is mounted on the hole to close the hole, and the second end portion is open to the outside of the silencer. In other words, the pipe has a generally U-shape, and the pipe comprises a first straight portion extending straight from the first end portion, an arc-shaped portion extending in an arc shape from the first straight portion, and a second straight portion extending straight from the arc-shaped portion to the second end portion. The first straight portion and the second straight portion are arranged substantially parallel to a direction of an axis of the cylindrical portion.

Accordingly, when compared with a construction in which the second end portion is open through a thorough hole formed in a component that differs from the closing portion (e.g., the cylindrical portion), the pipe can be made longer with effective use of a limited space in the main body of the silencer. Most portion of a pipe of a normal wind instrument other than a portion thereof near an end face of the bell is slender. Accordingly, the cylindrical portion of the silencer to be mounted on the bell also has an elongated shape in most cases. Since the silencer according to the present invention is constructed such that the pipe extends from the first end portion located near the closing portion toward the opposite side of the cylindrical portion from the closing portion and be bent so as to extend toward the closing portion, the length of the pipe can be made longer with effective use of a space in the elongated cylindrical portion. Accordingly, it is possible to easily achieve a construction in which a pipe longer than the largest diameter of the silencer (a maximum value of a length of a space of the silencer in a direction perpendicular to the axis of the cylindrical portion) is placed in the silencer and which is not achieved in the conventional technique (Japanese Patent No. 4114171).

While the pipe is preferably long for reduction in variation of pitch or interval and stabilization of sound waves as described above, an upper limit of the length of the pipe may be defined from another viewpoint. For example, the pipe may have such a length that does not cause resonance in each practical sound of the wind instrument. That is, there are practical sounds (i.e., a practical scale) used in an actual play in the wind instrument, and if the pipe has an excessively long length, resonance can be caused in each practical sound. In this construction, energy given to air by a player during playing of the wind instrument is consumed for resonance, and thereby energy for producing original playing sounds loses, deteriorating a blowing sensation. To solve this problem, where the pipe is constructed to have such a length that does not cause resonance in each practical sound of the wind instrument, it is possible to provide a silencer which is playable comfortably without loss of energy.

To construct the pipe having a length that does not cause resonance in each practical sound of the wind instrument, the length of the pipe may be set, using a discrete characteristic of frequencies of sounds used in the wind instrument (e.g., a relatively large difference in frequency between C and C#), so as to cause resonance between the pipe and a sound wave of a frequency between discrete frequencies. That is, the length of the pipe may be determined at a length that differs from a half-wavelength of each practical sound of the wind instrument.

To prevent resonance in practical sounds of the wind instrument, the length of the pipe may be shorter than a half-wavelength of the highest note in a practical scale (range) of the wind instrument. That is, the pipe having this length does not substantially cause resonance with respect to all sounds in the practical range of the wind instrument. For example, assuming that the highest note within the practical range of the trumpet is about 920 Hz and that the sound velocity is 340 m/s, a half of a wavelength of the highest note within the practical range is about 185 mm ($185 \approx (340/920/2) \times 1000$). Accordingly, by making the length of the pipe shorter than 185 mm, the pipe can be shorter than the half-wavelength of the highest note within the practical range of the trumpet.

The highest note within the practical range can be changed according to player's needs and a purpose of play. For example, where the highest note within the practical range is 1050 Hz in the case of jazz, the pipe may be shorter than 162 mm ($162 \approx (340/1050/2) \times 1000$).

The first end portion is disposed near the closing portion, and the nearer the first end portion is located to the closing portion, the farther the frequencies of sound waves which can cause dips and peaks are from the audible range. However, the first end portion cannot get near the closing portion to such an extent that a breath of a player has difficulty in entering into the pipe. Accordingly, the distance between the first end portion and the closing portion is preferably determined at such a distance that does not give a feeling of resistance to a player when a breath of the player is supplied to the pipe.

Examples of such a construction include a construction in which the cross-sectional area, in a direction perpendicular to a flow of the breath of the player, of a path or passage for the flow of the breath of the player which is formed between the first end portion and the closing portion is equal to or larger than the cross-sectional area of the pipe in a direction perpendicular to the axis of its inner circumference. That is, when the first end portion is disposed near the closing portion, the breath of the player is supplied into the pipe through a space defined between the first end portion and the closing portion, and accordingly the path for the breath of the player is formed between the first end portion and the closing portion. The size of the path can be defined by the cross-sectional area of the path for the breath of the player in the direction perpendicular to the flow of the breath of the player (a main flow in a case where the breath flows in a plurality of directions). Also, the inside of the pipe also functions as the path for the breath of the player. In this case, the size of the path can be defined by the cross-sectional area of the pipe in the direction perpendicular to the axis of its inner circumference. In a case where the cross-sectional area of the path for the flow is larger than the cross-sectional area of the pipe, excessive resistance is not generated when the breath of the player is supplied into the pipe. Accordingly, in the construction in which the cross-sectional area, in the direction perpendicular to the flow of the breath of the player, of the path for the flow of the breath of the player which is formed between the first end portion and the closing portion is equal to or larger than the cross-sectional area of the pipe in the direction perpendicular to the axis of its inner circumference, the first end portion can be disposed so as not to give a feeling of resistance to a player when the breath of the player is supplied to the pipe.

The silencer may be constructed such that the main body comprises a terminal, and a signal line extending from a microphone is connected to the terminal. Also, the silencer may further comprise an acoustical material provided on one of the closing portion of the main body and the pipe.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Hereinafter, there will be described one embodiment of the present invention in the following order: (1) Construction of Silencer; (2) Length of Performance Adjustment Pipe; and (3) Modifications.

(1) Construction of Silencer

Figure 1A:
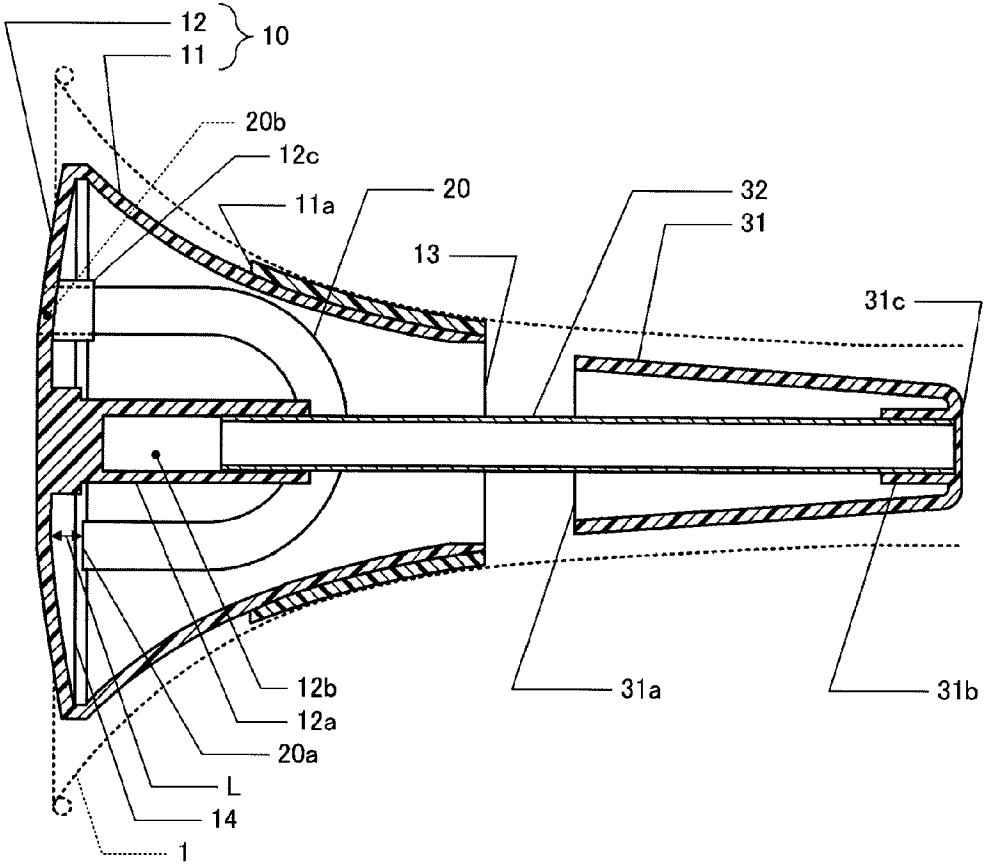
FIG. 1A is a cross-sectional view of a silencer.
Figure 1B:
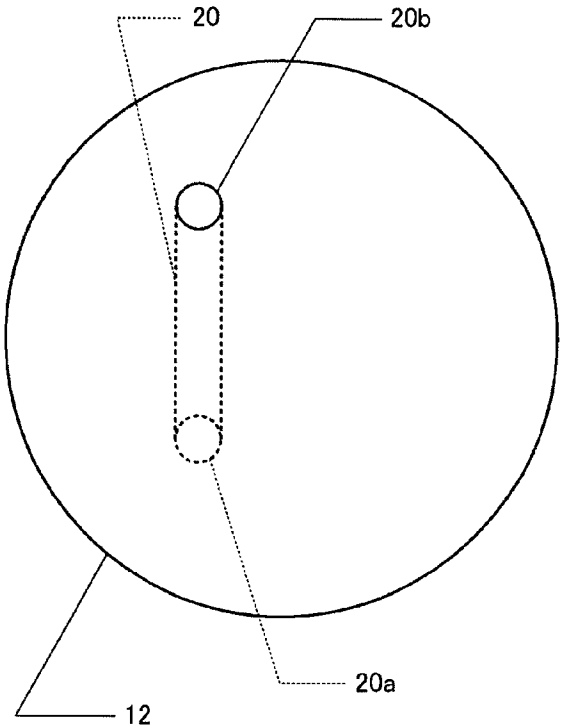
FIG. 1B is a view illustrating the silencer when viewed from a closing-portion side.

FIGS. 1A and 1B illustrate a silencer according to one embodiment of the present invention. FIG. 1A is a cross-sectional view of the silencer mounted on a bell 1 of a trumpet, taken along an axis of a pipe of the trumpet. In the present embodiment, the silencer includes a main body 10 constituted by a cylindrical portion 11 and a closing portion 12, and a performance adjustment pipe 20 is mounted inside the main body 10. The main body 10 is provided with a pitch adjuster 31 for adjusting a pitch.

The cylindrical portion 11 is formed of a plate member whose inside and outside diameters gradually change along its axis. That is, the cylindrical portion 11 has a shape of a generally frustum of a cone. In the present embodiment a wall surface corresponding to a side surface of the frustum of the cone is not a straight line but a curved line in cross section illustrated in FIG. 1A, and a curvature of the wall surface gradually changes along an axis of the cylindrical portion 11. Also, one end portion 14 of the cylindrical portion 11 in its axial direction is larger in inside diameter than the other end portion 13 thereof. In the present embodiment, the closing portion 12 is connected to the end portion 14 having the larger inside diameter (which corresponds to a lower base), and an opening is formed in the end portion 13 having the smaller inside diameter (which corresponds to an upper base). In view of the above, the main body 10 is a hollow member whose one end is open.

The closing portion 12 is formed of a plate member having a generally bowl outer surface that is exposed to the outside of the main body 10. An inner surface of the closing portion 12 also has a generally bowl shape. A boss 12*a* is formed on a center of the inner surface of the closing portion 12 (i.e., a point of intersection of an axis of the cylindrical portion 11 and the closing portion 12). The boss 12*a* is shaped like a column for securing a rod 32 extending from the pitch adjuster 31. The boss 12*a* is located in the main body 10 and extends along the axis of the cylindrical portion 11. The boss 12*a* has a circular cylindrical hole 12*b* having an axis coinciding with the axis of the cylindrical portion 11.

The rod 32 is a cylindrical member formed of metal such as aluminum. The outside diameter of the rod 32 is slightly smaller than the inside diameter of the hole 12*b* of the boss 12*a*. Accordingly, when the rod 32 is inserted into the hole 12*b*, the rod 32 can be secured to the boss 12*a*.

The pitch adjuster 31 is formed of a plate member having a shape of a generally frustum of a cone. In the present embodiment, a side surface of the frustum of the cone is a straight line in cross section illustrated in FIG. 1A. The frustum of the cone of the pitch adjuster 31 has an end portion 31*c* having a smaller inside diameter (which corresponds to an upper base) and an end portion 31*a* having a larger inside diameter (which corresponds to a lower base). The end portion 31*c* is closed, and the end portion 31*a* is open. Accordingly, the pitch adjuster 31 also is a hollow member whose one end is open. Formed on the end portion 31*c* of the pitch adjuster 31 is a boss 31*b* that is shaped like a column for securing the rod 32. The boss 31*b* is located in the pitch adjuster 31 and extends along the axis of the pitch adjuster 31. The boss 31*b* has a circular cylindrical hole having an axis coinciding with the axis of the pitch adjuster 31. The inside diameter of the hole is slightly larger than the outside diameter of the rod 32. Accordingly, when the rod 32 is inserted into the hole, the rod 32 can be secured to the boss 31*b*.

FIG. 1A illustrates a state in which the rod 32 is inserted in the hole 12*b* of the boss 12*a* and the hole of the boss 31*b*, and thereby the pitch adjuster 31 is mounted on the main body 10 via the rod 32. It is noted that when viewed in the axial direction of the pitch adjuster 31, the pitch adjuster 31 is entirely located in the opening formed in the end portion 13 of the cylindrical portion 11. Thus, the pitch adjuster 31 can be inserted into the main body 10 from the end portion 13 by moving the pitch adjuster 31 toward the main body 10 while pushing the rod 32 into the hole 12*b*, and the pitch adjuster 31 can be drawn until the rod 32 is released from the hole 12*b*, by moving the pitch adjuster 31 toward the other side of the main body 10 in the state in which the rod 32 is inserted in the hole 12*b*. Here, when a breath is supplied by a player with his or her lips placed on a mouthpiece mounted on a trumpet, a sound wave generated by vibrations of the lips of the player propagates. This sound wave generates a standing wave in the trumpet, and the generated standing wave determines a pitch of a sound emitted from the trumpet. Accordingly, a change in position of the pitch adjuster 31 can change a cross-sectional area of a path through which the sound wave propagates, making it possible to adjust the pitch of the sounds emitted from the trumpet.

In the present embodiment, wound around an outer circumferential surface of the cylindrical portion 11 is a shock absorber 11*a* formed of resin such as a sponge which has a large coefficient of friction. A change in curvature of the cylindrical portion 11 in unit distance in its axial direction is smaller than that of the bell 1 of the trumpet on which the main body 10 is to be mounted. Accordingly, when the end portion 13 of the main body 10 is inserted into the bell 1, and the main body 10 is moved into the bell 1, an outer circumferential surface of the shock absorber 11*a* mounted on the outer circumferential surface of the cylindrical portion 11 is brought into close contact with an inner circumferential surface of the bell 1. When the main body 10 is further pushed into the bell 1 in this state, the main body 10 is secured to the bell 1 by a frictional force with deformation of the shock absorber 11*a*.

In the present embodiment, the shock absorber 11*a* has a predetermined thickness. There is a certain latitude in amount of deformation of the shock absorber 11*a*, allowing a certain latitude in position at which the main body 10 is secured to the bell 1. This construction makes it possible to adjust the pitch by adjusting the position at which the main body 10 is secured to the bell 1.

The performance adjustment pipe 20 has a cylindrical shape, and its axis extends straight, then curves, and finally extends straight from its one end to the other end. That is, as illustrated in FIG. 1A, the performance adjustment pipe 20 is constituted by two straight portions generally parallel to each other and a curved (arc-shaped) portion (as one example of an arc-shaped portion) connected to the two straight portions.

The both ends of the performance adjustment pipe 20 are open, and as illustrated in FIG. 1B (that is a figure when the closing portion 12 is viewed from the outside of the main body 10), a first end portion 20*a* is open inside the main body 10 of the silencer, and a second end portion 20*b* is open outside the main body 10 of the silencer. That is, a boss 12*c* (as one example of a support portion) extending toward a player is formed on a back face of the closing portion 12 (i.e., inside the main body 10). The boss 12*c* has a circular cylindrical hole (as one example of a through hole) parallel to the axis of the cylindrical portion 11, and the hole extends through the front and back faces of the closing portion 12 (i.e., outer and inner faces of the main body 10). The inside diameter of the hole is slightly larger than the outside diameter of the performance adjustment pipe 20, allowing the performance adjustment pipe 20 to be secured to the closing portion 12 by inserting the second end portion 20*b* of the performance adjustment pipe 20 into the hole. When the second end portion 20*b* of the performance adjustment pipe 20 is inserted into the boss 12*c*, the second end portion 20*b* is open to the outside of the main body 10.

Since the performance adjustment pipe 20 is bent in a semicircular shape between the first end portion 20*a* and the second end portion 20*b*, the first end portion 20*a* of the performance adjustment pipe 20 is open in the same direction as the second end portion 20*b* in the state in which the second end portion 20*b* of the performance adjustment pipe 20 is fitted in the boss 12*c*. That is, as illustrated in FIGS. 1A and 1B, the first end portion 20*a* opens in a direction directed from the end portion 13 of the cylindrical portion 11 to the closing portion 12. While the performance adjustment pipe 20 has what is called a generally U-shape constituted by the straight portions and the curved portion, the straight portion including the second end portion 20*b* (as one example of a second straight portion) is longer than the straight portion including the first end portion 20*a* (as one example of a first straight portion). Accordingly, the first end portion 20*a* is spaced apart from the closing portion 12, so that the first end portion 20*a* is open near and toward the closing portion 12. That is, the first end portion 20*a* is disposed near the closing portion 12 so as to face the closing portion 12 in a first direction coinciding with the direction of the axis of the cylindrical portion 11. In the present embodiment having this construction, the breath of the player is supplied from the pipe of the trumpet into the main body 10, then is delivered to the first end portion 20*a* of the performance adjustment pipe 20, and finally is discharged from the second end portion 20*b* of the performance adjustment pipe 20 to the outside of the main body 10. It is noted that each of the two straight portions of the performance adjustment pipe 20 is disposed so as to extend in a direction generally parallel to the axis of the cylindrical portion 11.

In the present embodiment, the length and curvature of the performance adjustment pipe 20 are adjusted such that a distance L between the first end portion 20*a* and an inner wall of the closing portion 12 is less than 4.25 mm. That is, since the closing portion 12 functions as a reflective surface for sound waves, attenuation or resonance is caused between a traveling wave traveling to the closing portion 12 and a reflected wave reflected from the closing portion 12 in a case of sound waves in which twice the distance L between the first end portion 20*a* and the inner wall of the closing portion 12 is equal to an odd-numbered multiple of a half-wavelength or an integral multiple of a wavelength. Accordingly, dips and peaks frequently occur when compared with sound waves having other wavelengths. A condition achieving the shortest distance L among conditions in which attenuation or resonance is caused between the traveling wave traveling to the closing portion 12 and the reflected wave reflected from the closing portion 12 is the following equation: $2\times L=\text{wavelength}/2$. Thus, conversion of the distance L to frequency f using equation "frequency=sound velocity/wavelength" gives the following equation: $f=v/(4L)$, where v is sound velocity. Thus, assuming the sound velocity is 340 m/s, a frequency corresponding to the distance L of 4.25 mm is 20000 Hz ($=340/(4\times(4.25/1000))$). Accordingly, the distance L of 4.25 mm is a length in which attenuation or resonance is caused in the upper limit frequency in an audible range. In the present embodiment, the distance L between the first end portion 20*a* and the inner wall of the closing portion 12 is less than 4.25 mm to thereby prevent an occurrence of dips and peaks in the sound wave in the audible range.

In the case where the distance L between the first end portion 20*a* and the inner wall of the closing portion 12 is less than 4.25 mm, no dips and peaks occur in sound waves in the audible range. If the distance L is made excessively short, however, resistance is generated when the breath of the player is blown into the performance adjustment pipe 20. Accordingly, the distance L is set such that the player feels no resistance while playing. That is, the silencer is constructed such that the cross-sectional area, in a direction perpendicular to a flow of the breath of the player, of a path for the flow of the breath of the player which is formed between the first end portion 20*a* and the closing portion 12 is equal to or larger than the cross-sectional area of the performance adjustment pipe 20 in a direction perpendicular to an axis of its inner circumference.

In the present embodiment, assuming that an outer circumferential surface of the performance adjustment pipe 20 extends to a space formed between the first end portion 20*a* and the closing portion 12 and that the surface area of an outer circumferential surface of an extended portion of the performance adjustment pipe 20 is the cross-sectional area, in the direction perpendicular to the flow of the breath of the player, of the path for the flow of the breath of the player which is formed between the first end portion 20*a* and the closing portion 12, the silencer is constructed such that this cross-sectional area is equal to or larger than the cross-sectional area of the performance adjustment pipe 20 in the direction perpendicular to the axis of its inner circumference. This construction allows the first end portion 20*a* to be disposed so as not to give a feeling of resistance to the player when the breath of the player is supplied into the performance adjustment pipe 20.

(2) Length of Performance Adjustment Pipe

When a player plays a trumpet with the silencer being mounted on the trumpet, the player produces a sound by vibrating air existing between the mouthpiece and the silencer. In a case where there is an acoustic resistor (which is a material providing an acoustic resistance) in the silencer, vibrations of air are less freely generated, stabilizing sound waves to be produced in the silencer. In the present embodiment, the performance adjustment pipe 20 is mounted in the main body 10 and includes: the first end portion 20*a* opening inside the main body 10; and the second end portion 20*b* opening outside the main body 10. In the present embodiment, accordingly, the sound waves can be stabilized more easily when compared with a case where the performance adjustment pipe 20 is not provided in the main body 10.

The longer the length of the performance adjustment pipe 20, the more easily it is possible to lower the degree of freedom in generation of vibrations of the air. Thus, the longer the length of the performance adjustment pipe 20, the more easily sound waves to be produced in the main body 10 can be stabilized. In the present embodiment, the performance adjustment pipe 20 is bent or curved between the first end portion 20*a* and the second end portion 20*b*. Accordingly, the performance adjustment pipe 20 can be made as long as possible in a limited space defined inside the main body 10 of the silencer. This construction results in smaller size in the silencer and more stabilized sound waves to be produced in the silencer, providing a silencer which generally offers high performance.

In the present embodiment, the player supplies a breath from the first end portion 20*a*, and the breath is discharged from the second end portion 20*b* through the performance adjustment pipe 20, eliminating a need for the closing portion 12 to have a hole for establishing direct communication between the inside and outside of the main body 10 of the silencer. In the case where the closing portion 12 has the hole for establishing direct communication between the inside and outside of the main body 10 of the silencer or where the performance adjustment pipe 20 does not have enough length, the closing portion 12 less functions as the reflective surface for sound waves. In the present embodiment, however, the closing portion 12 reliably functions as the reflective surface for sound waves, thereby easily stabilizing sound waves.

It is noted that, in the construction in which the closing portion 12 functions as the reflective surface for sound waves, the closing portion clearly functions as the reflective surface with the longer length of the performance adjustment pipe 20, whereby variations of sounds emitted from a brass instrument can be reduced when compared with the case of the silencer with a reduced function of the closing portion. Therefore, in the present embodiment in which the performance adjustment pipe 20 is bent between the first end portion 20*a* and the second end portion 20*b*, the player can produce a sound that is similar to a sound produced in a case where no silencer is used.

Figure 2A:
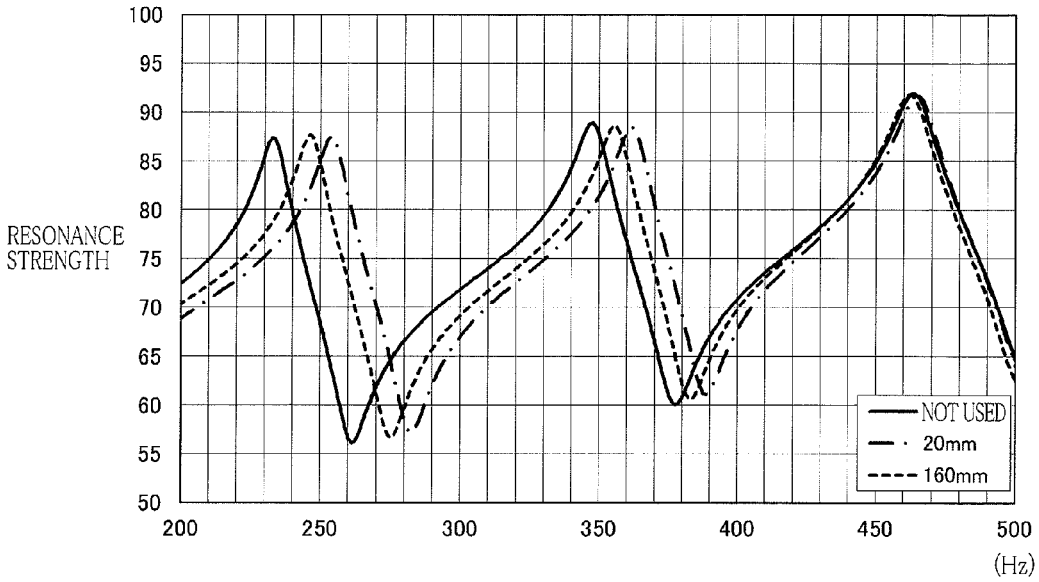
FIGS. 2A and 2B are views each illustrating a frequency response (i.e., a frequency characteristic) with respect to the magnitude of a resonance strength in each length of a pipe.

There will be next explained, with reference to figures, effects obtained by the long performance adjustment pipe 20. FIG. 2A illustrates a frequency response with respect to the magnitude of a resonance strength in each length of the performance adjustment pipe 20. In FIG. 2A, the one-dot chain line indicates a frequency response in a case where the performance adjustment pipe 20 is a straight pipe having the length of 20 mm, and the broken line indicates a frequency response in a case where the performance adjustment pipe 20 is a bent pipe as illustrated in FIG. 1A which has the length of 160 mm. It is noted that the solid line indicates a frequency response of the magnitude of the resonance strength in the case where the silencer is not mounted on the bell 1. Accordingly, portions of the frequency response indicated by the solid line which exhibit peaks of the magnitude of the resonance strength correspond to normal sounds emitted from a trumpet in the state in which no silencer is used.

In all frequency ranges illustrated in FIG. 2A, peaks of the resonance strength appear at frequencies nearer to frequencies of peaks of a resonance strength in the case of no use of the silencer in the performance adjustment pipe 20 having the length of 160 mm than in the performance adjustment pipe 20 having the length of 20 mm. Accordingly, the longer performance adjustment pipe 20 can produce sounds that are closer to a pitch of a sound produced by the trumpet with no silencer.

Figure 2B:
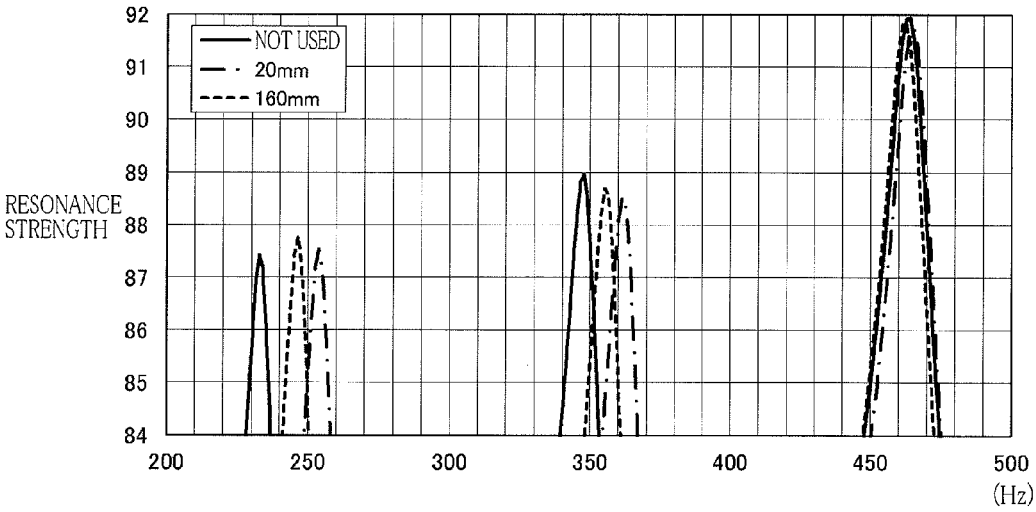

FIG. 2B is an enlarged view of a range near peak strengths (i.e., a range of resonance strengths from 84 to 92) in FIG. 2A. As illustrated in FIG. 2B, when the performance adjustment pipe 20 having the length of 20 mm and the performance adjustment pipe 20 having the length of 160 mm are compared with each other, resonance strengths at peaks are larger in all frequency ranges illustrated in FIG. 2B in the performance adjustment pipe 20 having the length of 160 mm than in the performance adjustment pipe 20 having the length of 20 mm. Accordingly, the performance adjustment pipe 20 having the length of 160 mm can easily produce resonance sounds than the performance adjustment pipe 20 having the length of 20 mm. That is, the player can easily stabilize sound waves with the longer performance adjustment pipe.

As described above, the performance adjustment pipe is preferably made as long as possible to prevent changes in pitch and stabilize sound waves. In the present embodiment, however, an upper limit is provided for the length of the performance adjustment pipe from another viewpoint. That is, in the present embodiment, the length of the performance adjustment pipe 20 is determined to be shorter than a half-wavelength of the highest note within a practical range of the trumpet. This construction causes no resonance in practical sounds of the trumpet. It is noted that the wordings "practical sounds" mean a practical scale, and the practical scale means pitches of sounds which can be substantially produced by the instrument including the bell 1.

Figure 3:
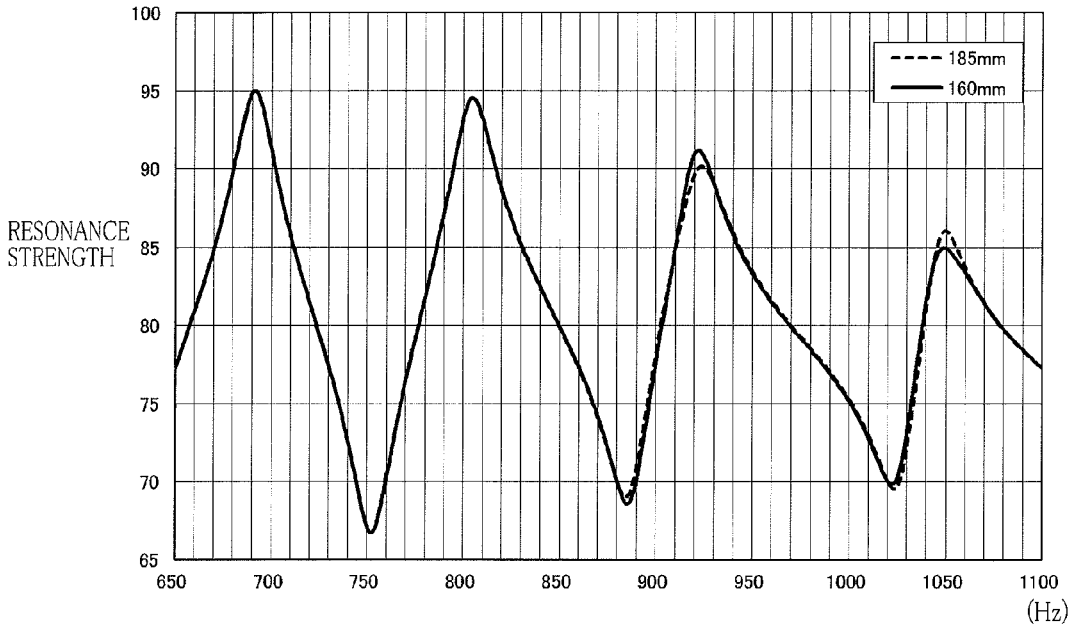
FIG. 3 is a view illustrating a frequency response with respect to the magnitude of a resonance strength in each length of the pipe.

FIG. 3 illustrates a frequency response with respect to the magnitude of the resonance strength in each length of the performance adjustment pipe 20. In FIG. 3, the broken line indicates a frequency response in a case where the performance adjustment pipe 20 is a bent pipe as illustrated in FIG. 1A which has the length of 185 mm, and the solid line indicates a frequency response in a case where the performance adjustment pipe 20 is a bent pipe as illustrated in FIG. 1A which has the length of 160 mm. As illustrated in FIG. 3, in the highest note of 920 Hz within a normal practical range of the trumpet, the resonance strength at the peak is smaller in the performance adjustment pipe 20 having the length of 185 mm than in the performance adjustment pipe 20 having the length of 160 mm.

It is possible to consider that the reason why the resonance strength at the peak is small as described above is that energy given to air by a player during playing of the trumpet is consumed for resonance in the performance adjustment pipe 20, resulting in loss of energy for producing original playing sounds. That is, in a case where a half of the wavelength of the sound wave is equal to the length of the performance adjustment pipe 20, the energy for producing the original playing sounds is considered to lose. Here, assuming that the highest note in the practical range (i.e., the practical scale) of the trumpet is about 920 Hz and that the sound velocity is 340 m/s, the half of the wavelength of the highest note within the practical range is about 185 mm ($185 \approx (340/920/2) \times 1000$). Accordingly, the performance adjustment pipe 20 having the length of 185 mm is smaller in the resonance strength at the peak around 920 Hz than the performance adjustment pipe 20 having the length of 160 mm due to loss of energy. Accordingly, by making the length of the performance adjustment pipe 20 less than 185 mm (e.g., 160 mm as illustrated in FIG. 3), it is possible to provide a silencer which is playable comfortably without loss of energy.

(3) Modifications

In the present invention, other constructions can be employed as long as the bent performance adjustment pipe is mounted in the main body of the silencer. For example, the shape of the performance adjustment pipe and the direction of its bending are not limited to those illustrated in FIG. 1A.

Figure 4A:
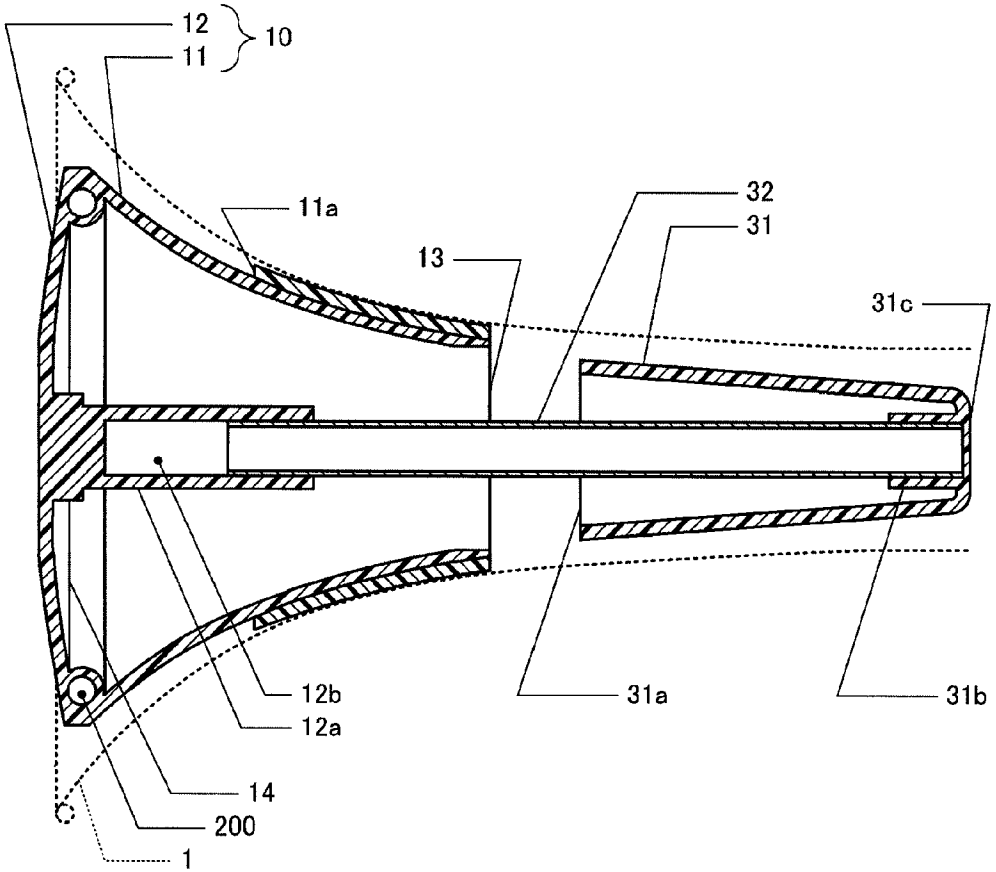
FIG. 4A is a cross-sectional view of a silencer.
Figure 4B:
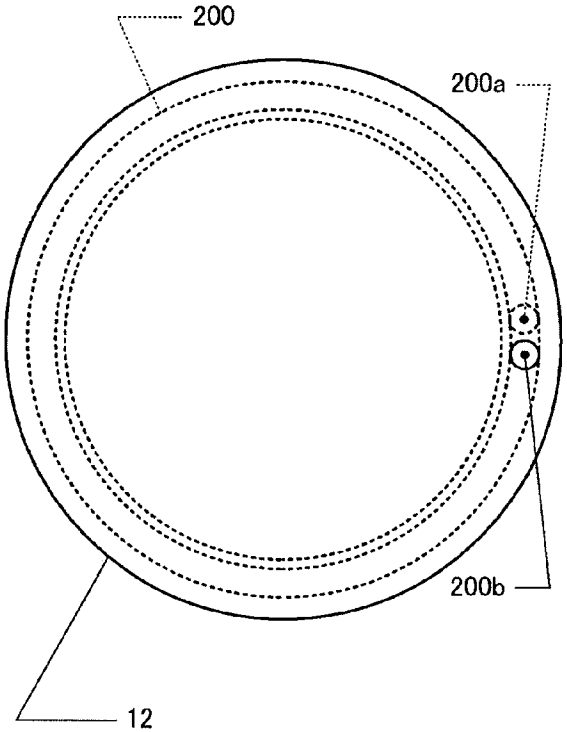
FIG. 4B is a view illustrating the silencer when viewed from the closing-portion side.

FIGS. 4A and 4B illustrate a modification in which a performance adjustment pipe is formed along a circumference of a closing portion. FIG. 4A is a cross-sectional view of a silencer taken along an axis of a trumpet, and FIG. 4B is a view of the silencer when the silencer is viewed from a closing-portion side. It is noted that the same reference numerals as used in the above-described embodiment illustrated in FIGS. 1A and 1B are used to designate the corresponding elements of this modification, and an explanation of which is dispensed with. In the present embodiment, a performance adjustment pipe 200 is formed along a circumference of the closing portion 12 shaped like a bowl. That is, the performance adjustment pipe 200 is formed on an inner side of the closing portion 12 along its circumference, specifically, the cylindrical member having an axis parallel to the circumference of the bowl-shape portion is connected to the circumference of the closing portion 12.

The performance adjustment pipe 200 has: an opening 200*a* which opens inside the main body 10; and an opening 200*b* which opens outside the main body 10. Accordingly, in the present embodiment, a breath of a player is supplied into the main body 10, then is delivered from the opening 200*a* into the performance adjustment pipe 200, and finally is discharged from the opening 200*b* to the outside of the main body 10 through the performance adjustment pipe 200. Since the performance adjustment pipe 200 is formed along the circumference of the closing portion 12, the performance adjustment pipe 200 having a relatively long length can be disposed in a limited space inside the main body 10.

Figure 5:
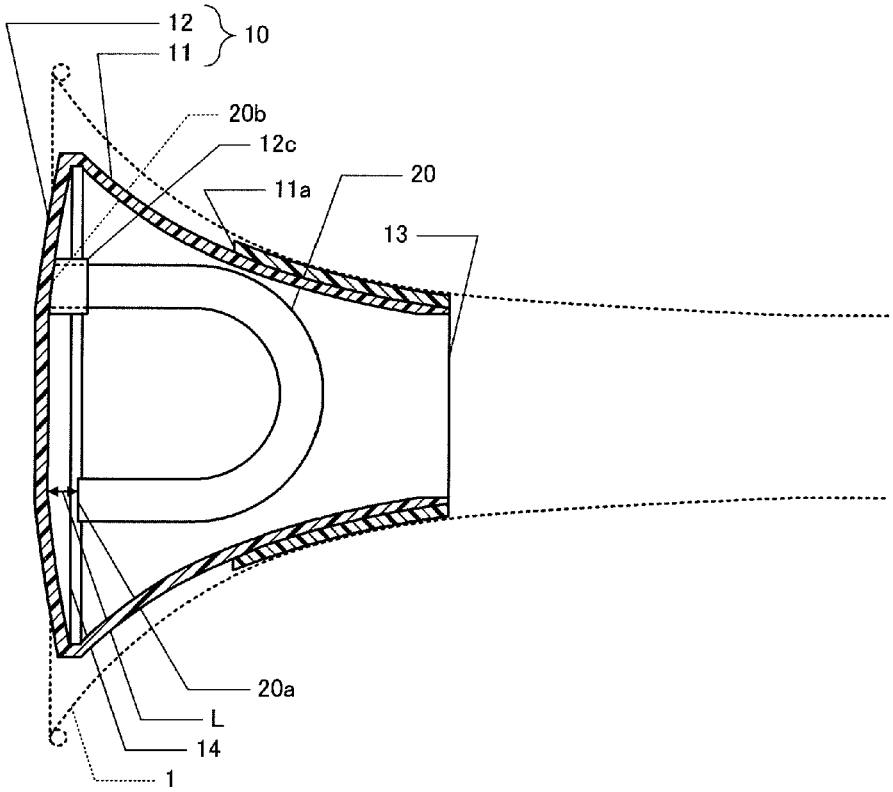
FIG. 5 is a cross-sectional view of a silencer.

While the pitch adjuster 31 is mounted in FIG. 1A, a pitch adjuster 31 having a size and a shape different from those of the pitch adjuster 31 illustrated in FIG. 1A may be mounted on the main body 10, and as illustrated in FIG. 5 a silencer used without the pitch adjuster 31 may be constructed. Also, while the performance adjustment pipe 20 is supported by the boss 12*c* provided on the closing portion 12 in the above-described embodiment, the performance adjustment pipe 20 may be supported by a support portion provided on the main body 10 which is different from the closing portion 12.

Figure 7A:
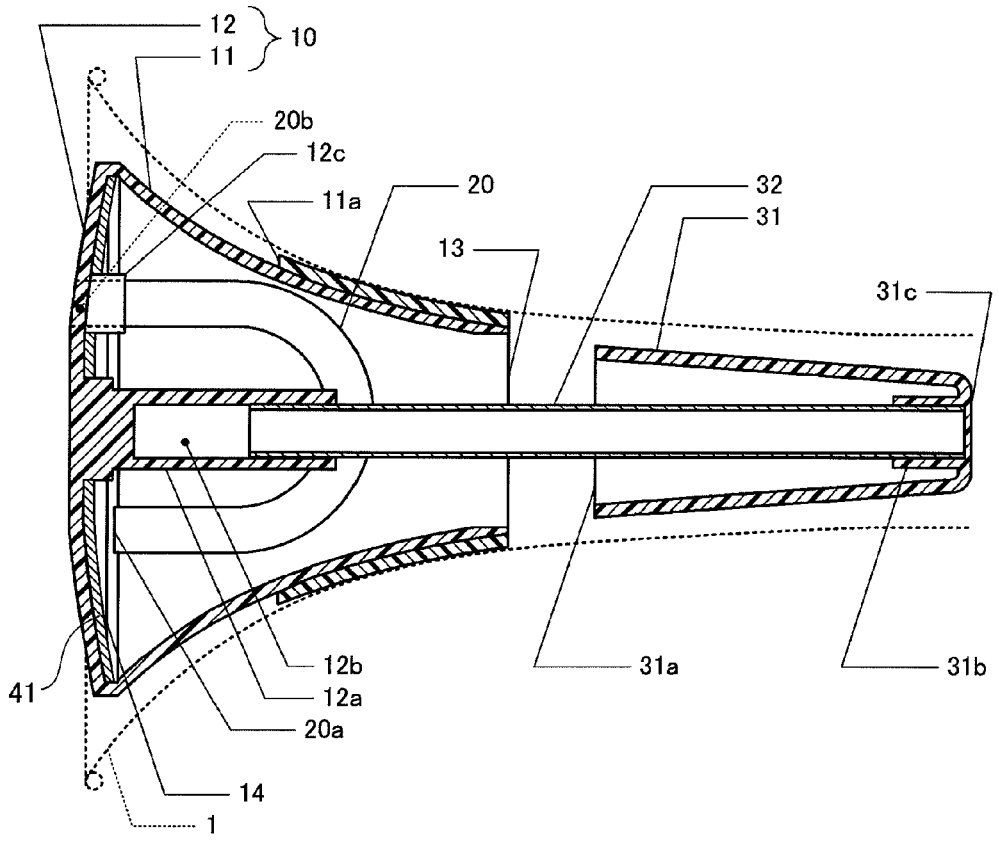
FIGS. 7A, 7B, and 7C are cross-sectional views of silencers each provided with an acoustical material (i.e., a sound absorber).
Figure 7B:
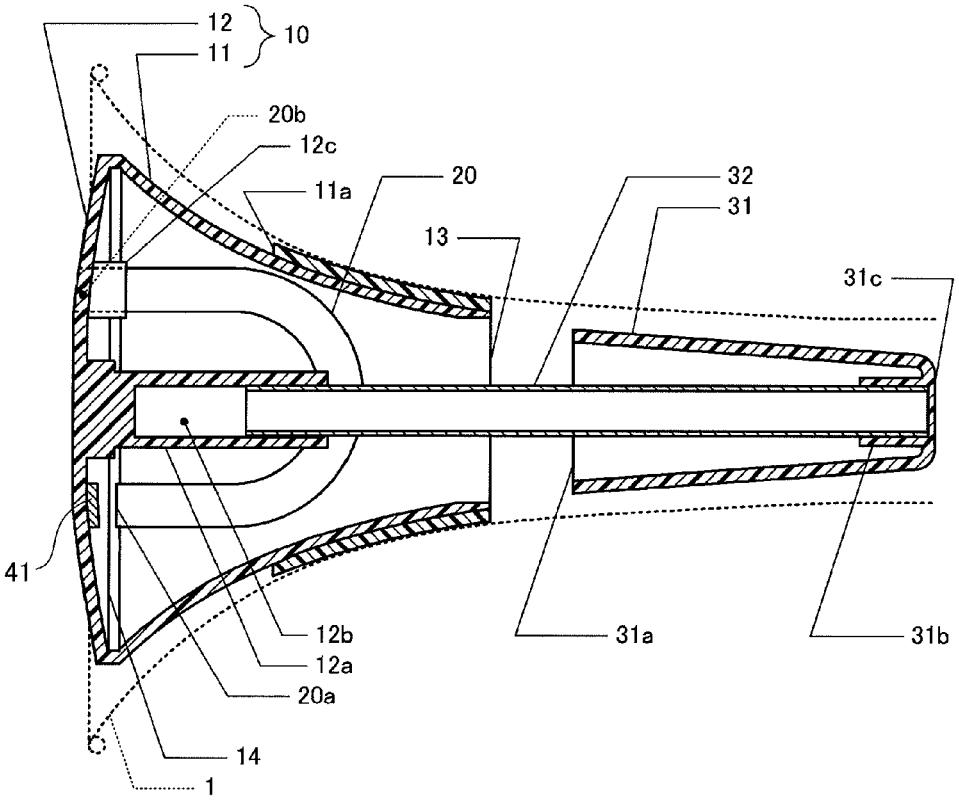
Figure 7C:
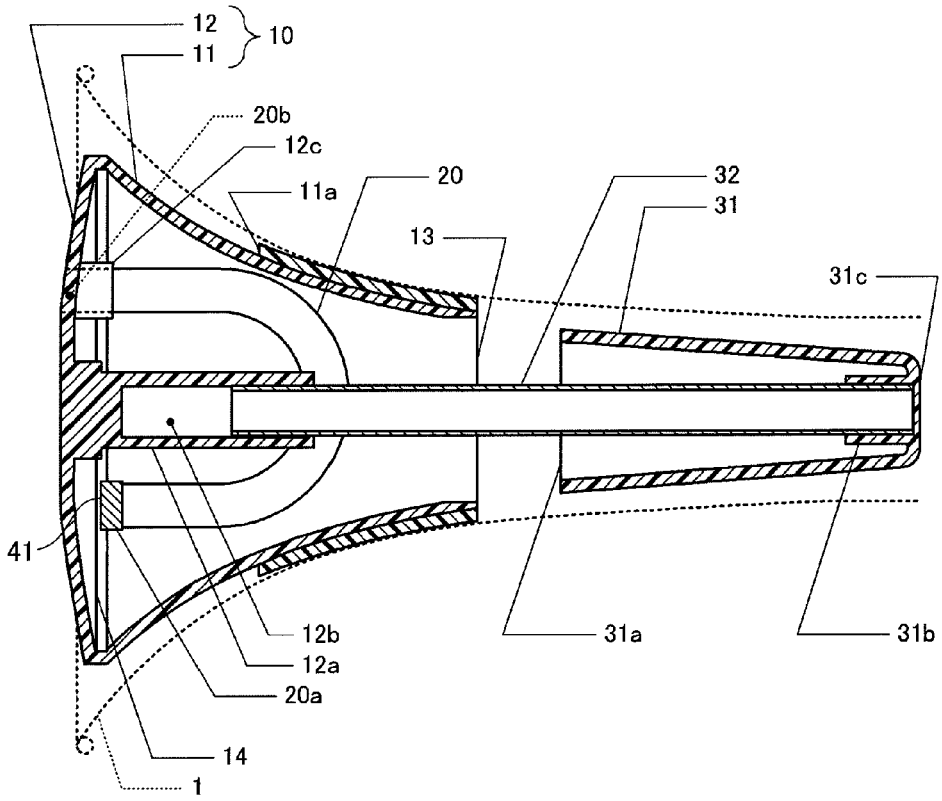

Sounds output from the silencer can be adjusted in various methods, an acoustical material (i.e., a sound absorber) for absorbing sound waves within a range of specific frequencies may be mounted on the inside of the closing portion 12. For example, as illustrated in FIGS. 7A-7C, an acoustical material (i.e., a sound absorber) 41 for absorbing sound waves within a mid- or high-range in a range used in the brass instrument may be mounted on the inside of the closing portion 12 or on a portion of an outer circumferential surface of the performance adjustment pipe 20 which is located near the first end portion 20*a*, whereby a relatively smaller amount of components of sound in the mid- and high-range enter into the performance adjustment pipe 20, leading to a softer sound.

Figure 6:
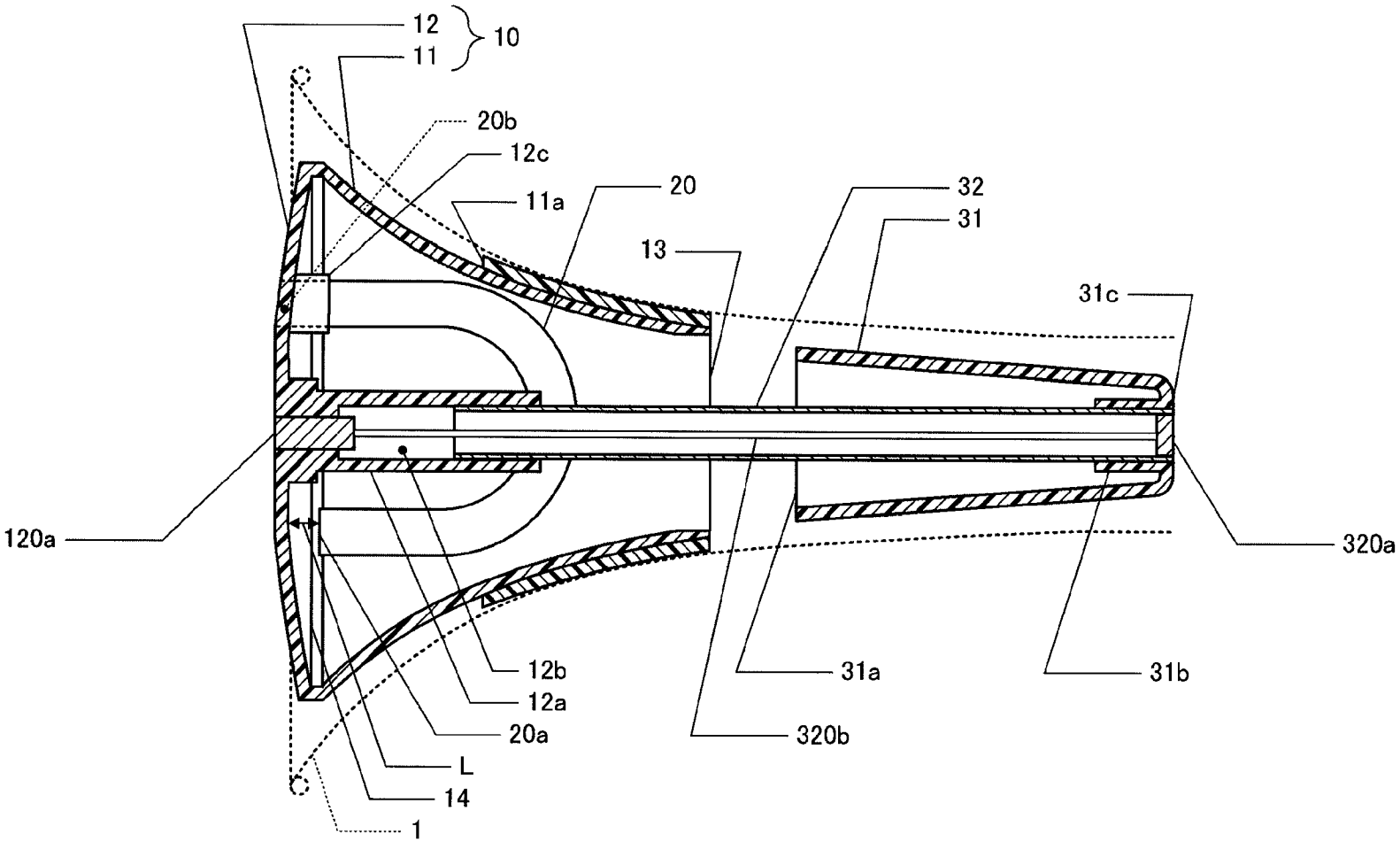
FIG. 6 is a cross-sectional view of a silencer.

This silencer may further be constructed such that sounds are collected by a microphone during silencing performed by the silencer, and a specific person, e.g., a player can listen to the collected sounds. FIG. 6 is a view illustrating an example of a construction in which a microphone can be mounted on the silencer. It is noted that the same reference numerals as used in the embodiment illustrated in FIG. 1A are used to designate the corresponding elements of this modification illustrated in FIG. 6, and an explanation of which is dispensed with. In the construction illustrated in FIG. 6, the rod 32 extends through the end portion 31*c* of the pitch adjuster 31, and a microphone 320*a* is attached to an end portion of the rod 32. A terminal 120*a* is mounted on a center of the closing portion 12, and a signal line 320*b* is connected to the microphone 320*a* and the terminal 120*a*. When an output signal line connected to, e.g., an amplifier is connected to the terminal 120*a* in a state in which the silencer having this construction is mounted on a bell of a brass instrument, a playing sound can be converted to a sound having a desired volume by, e.g., the amplifier while silencing a sound produced by the brass instrument, and a specific person can listen to the sound. It is noted that a position at which the microphone 320*a* is attached is not limited to the end portion of the rod 32, and the microphone 320*a* may be disposed at any place as long as the microphone 320*a* can detect the playing sound in the silencer. An output signal of the microphone 320*a* is not necessarily transmitted to, e.g., the amplifier through wired communication and may be transmitted through wireless communication. Also, while the silencer is applied to the brass instrument in the above-described embodiment, the silencer may be applied to a woodwind.

What is claimed is:

1. A silencer comprising:

a main body comprising a cylindrical portion having first and second ends, an outer circumferential surface of the main body being adapted to be mounted on an inner circumferential surface of a bell of a wind instrument, and a closing portion which closes the first end of the cylindrical portion; and a pipe comprising first and second end portions connected by a bent portion, the first end portion opening inside the main body near the closing portion, the second end portion opening outside the main body via the closing portion.

2. The silencer according to claim 1, wherein the cylindrical portion is adapted to be mounted on the inner circumferential surface of the bell such that the outer circumferential surface of the cylindrical portion is held in contact with the inner circumferential surface of the bell.

3. The silencer according to claim 1, wherein the first end portion of the pipe faces the closing portion in a first direction which is parallel to an axis of the cylindrical portion.

4. The silencer according to claim 1, wherein:

an opening is formed in the second end of the cylindrical portion, and the in the closed portion extends along an axis which is parallel to an axis of the cylindrical portion.

5. The silencer according to claim 1, wherein the second end portion of the pipe is supported by a support portion formed in the cylindrical portion and is open to the outside of the main body through a through hole formed in the closing portion.

6. The silencer according to claim 1, wherein the pipe has a generally U-shape.

7. The silencer according to claim 1, wherein the pipe comprises a first straight portion extending straight from the first end portion, an arc-shaped portion extending in an arc shape from the first straight portion, and a second straight portion extending straight from the arc-shaped portion to the second end portion.

8. The silencer according to claim 7, wherein the first straight portion and the second straight portion are arranged substantially parallel to a direction of an axis of the cylindrical portion.

9. The silencer according to claim 1, wherein a length of the pipe differs from a half-wavelength of each practical scale of the wind instrument.

10. The silencer according to claim 1, a length of the pipe is less than a half-wavelength of the highest note in a practical scale of the wind instrument.

11. The silencer according to claim 1, wherein a distance between the first end portion of the pipe and the closing portion in a direction of an axis of the cylindrical portion is less than 17 mm.

12. The silencer according to claim 1, wherein the main body comprises a terminal, and wherein a signal line extending form a microphone is connected to the terminal.

13. The silencer according to claim 1, further comprising an acoustical material provided on one of the closing portion of the main body and the pipe.

* * * * *